US006298605B1

(12) United States Patent
Delefosse et al.

(10) Patent No.: US 6,298,605 B1
(45) Date of Patent: Oct. 9, 2001

(54) MECHANICAL SAFETY DEVICE FOR A DOOR PIVOTALLY MOUNTED ON A FRAME

(76) Inventors: Bruno Delefosse, 4 Place de la Republique, 38400 Saint Martin d'Heres; Raymond Burdel, 35 Bis Route de Chartreuse, 38700 La Tronche; Christophe Ringeval, 111 Avenue de la Republique, 38130 Echirolles, all of (FR)

( * ) Notice: Subject to any disclaimer, the term of this patent is extended or adjusted under 35 U.S.C. 154(b) by 0 days.

(21) Appl. No.: 09/520,187

(22) Filed: Mar. 7, 2000

(30) Foreign Application Priority Data

Mar. 10, 1999 (FR) ..... 99 03121

(51) Int. Cl.[7] ..... E06B 3/88
(52) U.S. Cl. ..... 49/383; 49/384; 49/381
(58) Field of Search ..... 49/383, 384, 381; 160/40, 229.1

(56) References Cited

U.S. PATENT DOCUMENTS

| | | | | |
|---|---|---|---|---|
| 1,626,844 | * | 5/1927 | Kuhn | 160/229.1 |
| 2,867,858 | * | 1/1959 | Wiesner | 49/383 |
| 2,910,741 | * | 11/1959 | Dettman | 49/383 |
| 3,302,690 | * | 2/1967 | Hurd | 160/40 |
| 4,261,140 | * | 4/1981 | Mclean | 49/383 |
| 4,290,233 | | 9/1981 | Hubbard . | |
| 5,001,862 | * | 3/1991 | Albenda | 49/383 |
| 5,359,812 | | 11/1994 | Mayfield . | |
| 5,419,084 | * | 5/1995 | Sankey et al. | 49/383 |
| 5,778,601 | * | 7/1998 | Wu | 49/383 |
| 6,029,409 | * | 2/2000 | Wilson | 52/202 |

FOREIGN PATENT DOCUMENTS

| | | | |
|---|---|---|---|
| 25 18 743 A | | 11/1976 | (DE) . |
| 36 07 178 A1 | | 9/1987 | (DE) . |
| 37 16 654 A1 | | 12/1988 | (DE) . |
| 4207385 | * | 9/1993 | (DE) . |
| 2 565 622 | | 12/1985 | (FR) . |
| 2 620 484 | | 3/1989 | (FR) . |
| 2 646 460 | | 11/1990 | (FR) . |
| 0 148 990 A | | 6/1985 | (GB) . |

* cited by examiner

*Primary Examiner*—Gregory J. Strimbu
(74) *Attorney, Agent, or Firm*—Oliff & Berridge, PLC

(57) ABSTRACT

A safety device for a door is arranged to prevent access to the vertical gap situated on the side where the hinges are located between the frame and the rear edge of the door. The safety device comprises a protection unit having at least one tubular element fitted in the gap in vertical alignment with the hinges, and a strip made of flexible or semi-rigid material arranged on the side opposite the tubular element. The fixing part for fixing the strip onto the frame comprises a rounding unit for rounding the strip over the whole height thereof so as to perform preliminary bending of the strip at a predetermined angle. The strip and the plate extending down to the bottom of the door to achieve total protection.

8 Claims, 4 Drawing Sheets

MECHANICAL SAFETY DEVICE FOR A DOOR PIVOTALLY MOUNTED ON A FRAME

BACKGROUND OF THE INVENTION

The invention relates to a mechanical safety device for a door pivotally mounted in a frame between an open position and a closed position, the device being equipped with protection means to prevent fingers from getting jammed when the door is closed, by preventing access to the vertical gap arranged on the side where the hinges are located between the frame and the rear edge of the door by means of a strip made of flexible or semi-rigid material fixed to the frame and cooperating in the intermediate part with a guiding part to arrange a pre-determined clearance with respect lo the door, authorizing a relative sliding movement of the free end of the strip when angular variation of the gap takes place, the guiding pant being fixed to the door by assembly elements.

STATE OF THE TECHNIQUE

Risks of fingers getting jammed between the door and the support frame can occur on the side where the closing handle is situated, and on the side where the hinges are located as a result of deliberate or involuntary slamming of the door without the handle being used.

For protection on the side where the hinges are located, it is state of the art to make use of a flap folded into a concertina, or a flexible gusset which is deformed according to the angle of pivoting of the door to prevent access to the gap. Such devices are described in the documents FR-A-2620484, 2565622, and 2646460, and present a large swelling in the open position of the door. Such a swelling is unaesthetic and moreover increases the force required to move the door when deformation of the flap or gusset takes place.

The document DE 3607178 describes a door protection by means of a flexible strip cooperating with a guiding slot. The of angular deformation of the strip in the zone to be protected nevertheless remains large.

In the document DE 3716654, protection is performed by a spring in the form of a rolling flap fixed to the top and to the bottom pan of the door.

OBJECT OF THE INVENTION

The object of the invention is to achieve a reliable safety device, able to be easily fitted to all types of hinged doors, not presenting any protruding part regardless of the angle of pivoting of the door, and enabling total protection to be achieved along the height of the door, and on both the apparent (i.e., where the hinges are visible when the door is closed) and non-apparent (i.e., where the hinges are not visible when the door is closed) sides of the hinges.

The device according to the invention is characterized in that:

- a fixing part for fixing a strip onto a frame comprises means for rounding the strip over the whole height thereof so as to perform preliminary bending of the curved surface at a predetermined angle,
- a guiding part comprises a plate made of rigid plastic material whose vertical edge located opposite the hinges is secured to the door by assembly elements, constituting the closed bottom of a guiding slot for housing the sliding part of the strip,
- the strip and the plate extend right down to the bottom of the door to achieve total protection.

According to one feature of the invention, the strip is made of plastic material of small thickness having a variable curved surface in the zone to be protected and remaining appreciably parallel to the door beyond the guiding part.

The coaxial arrangement of the tubular element with the hinges and the sliding movement of the flexible strip prevent any swelling effect when the door is opened. The tubular element has a diameter close to that of each hinge and is provided with a flat fixing tab, the assembly thus formed having the form of a profiled part made of rigid or flexible plastic material able to be assembled either to the frame or to the door.

BRIEF DESCRIPTION OF THE DRAWINGS

Other advantages and features will become more clearly apparent from the following description of an embodiment of the invention given as a non-restrictive example only and represented in the accompanying drawings in which.

DESCRIPTION OF A PREFERRED EMBODIMENT

Figure 1:
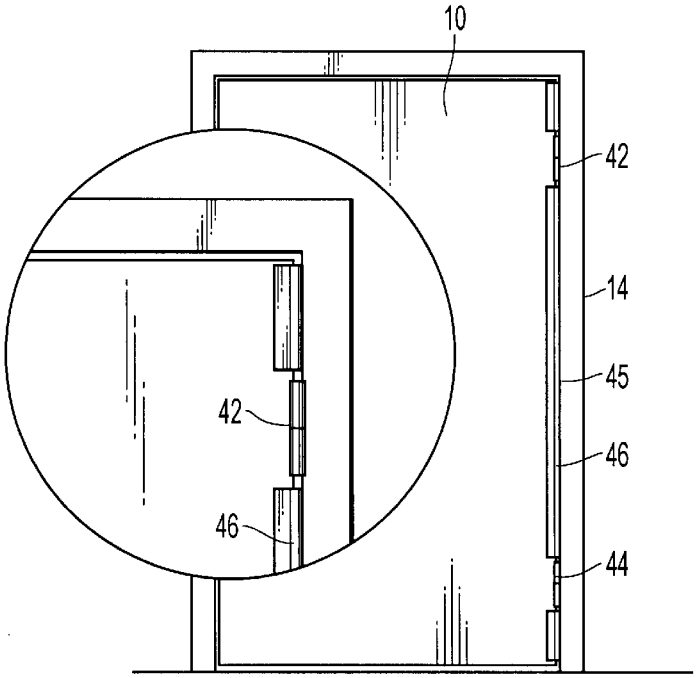
FIGS. 1 and 2 are schematic views of a hinged door equipped with a safety device, represented on the apparent side of the hinges, and on the non-apparent side of the hinges, respectively.
Figure 2:
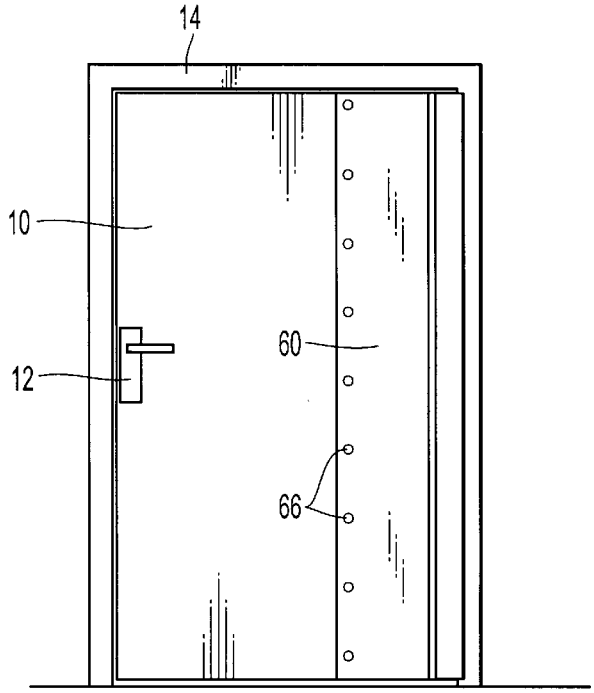

With reference to the figures, a door 10 with hinges 42, 44 comprises an actuating handle 12 and a protection unit 40 to prevent fingers from getting jammed when the door 10 is closed, by preventing access to the vertical gap 45 arranged on the side where the hinges 42, 44 are located between the frame 14 and the rear edge 48 of the door 10.

Figure 3:
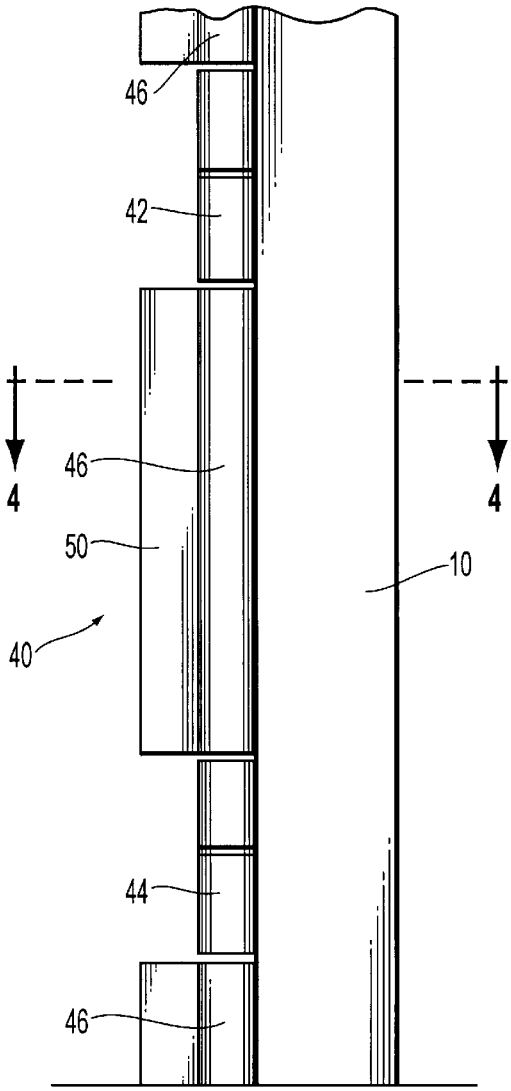
FIG. 3 is a schematic view on an enlarged scale of the safety device of FIG. 1 arranged on the apparent side of the hinges.
Figure 4:
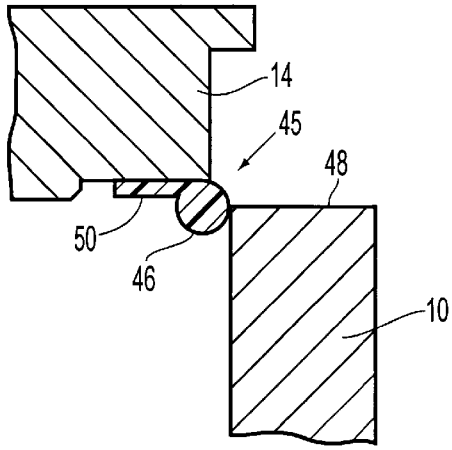
FIG. 4 shows a cross-sectional view along the line 4—4 of FIG. 3 when the door is open.
Figure 5:
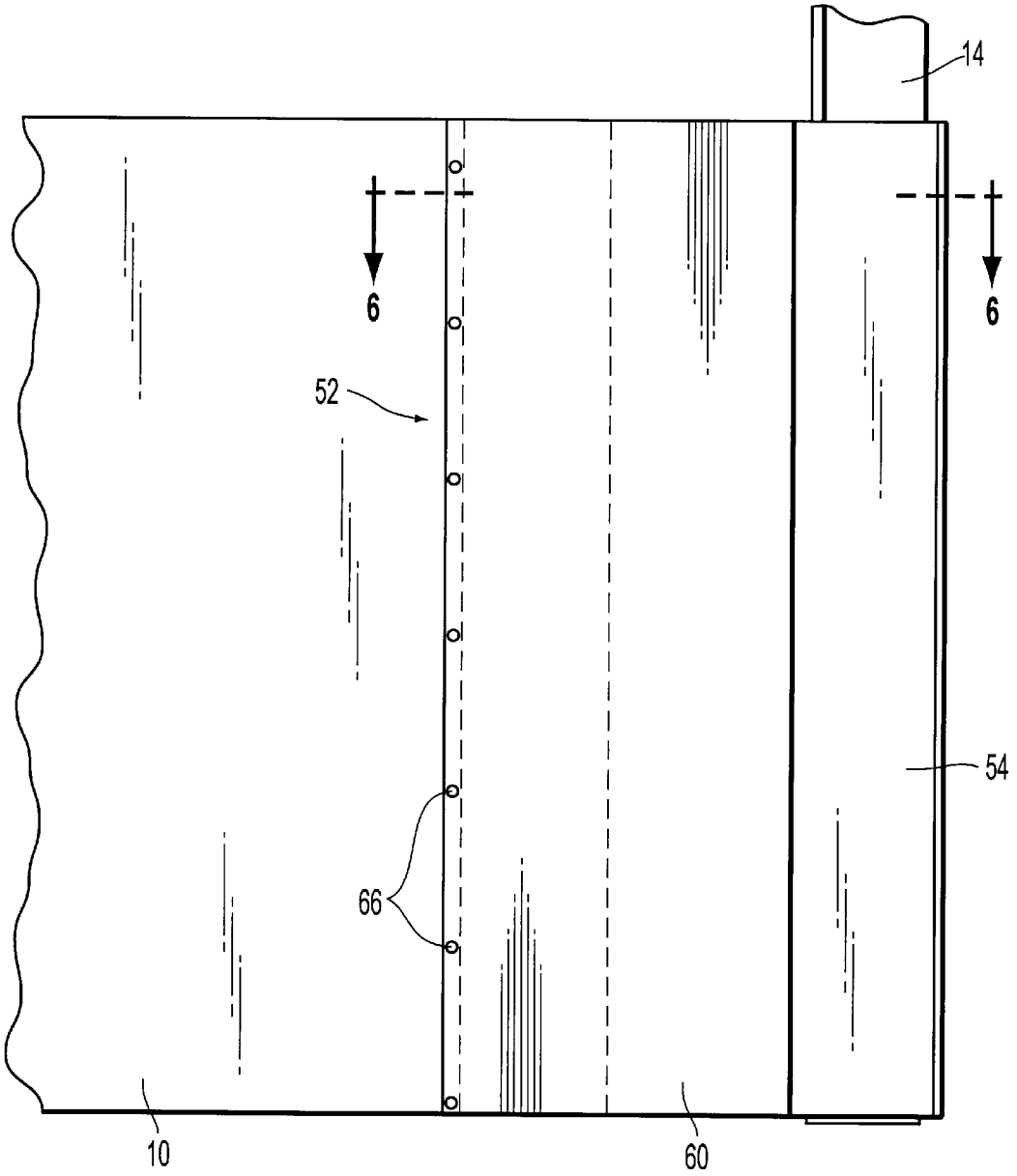
FIG. 5 is a schematic view on an enlarged scale of the safety device of FIG. 1 arranged on the non-apparent side of the hinges.
Figure 6:
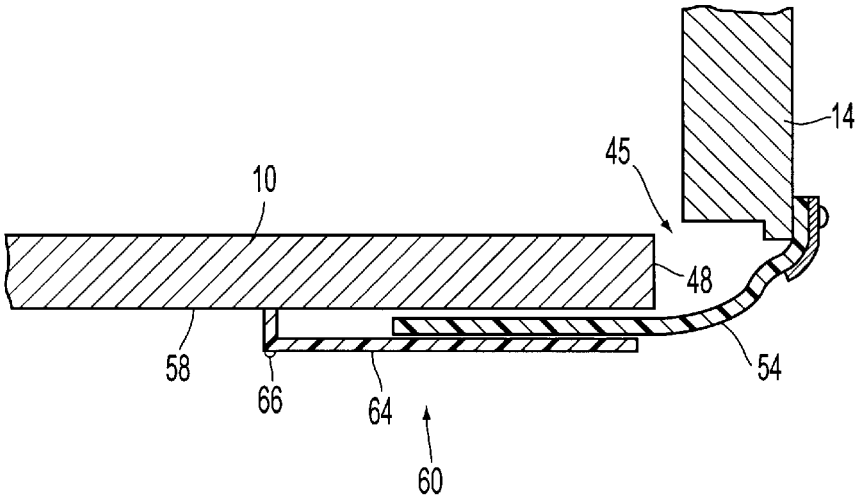
FIG. 6 represents a cross-sectional view along the line 6—6 of FIG. 5 when the door is open.
Figure 7:
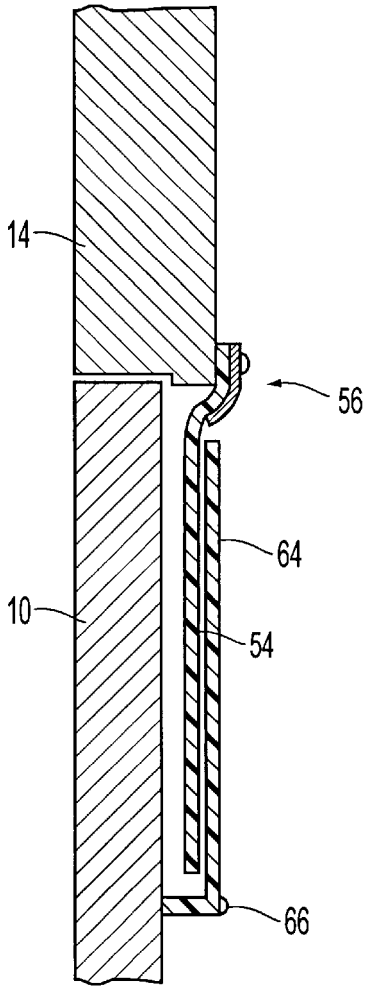
FIG. 7 is an identical view to FIG. 6 when the door is closed.
Figure 8:
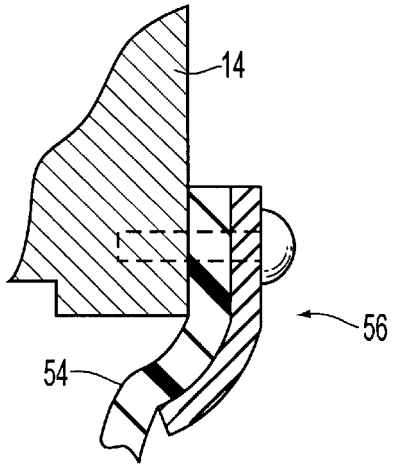
FIG. 8 is a detailed view of FIG. 7.

FIGS. 3 and 4 show the protection device 40 for the apparent side of the door. As shown in FIGS. 3 and 4, the protection unit 40 comprise tubular elements 46 in the form of elongated profiled parts on the apparent side of the hinges 42, 44 (FIGS. 1, 3 and 4). These tubular elements 46 are fitted in vertical alignment with the hinges 42, 44 in such a way as to permanently fill the vertical gap 45 that appears between the frame 14 and the rear edge 48 of the door 10 when pivoting of the door takes place. Each tubular element 46 presents a diameter close to that of the hinges 42, 44, and is provided with a flat fixing tab 50 able to be assembled either to the frame 14 or to the door 10. The tubular elements 48 are fitted between the hinges 42, 44 along the height of the door 10 and are advantageously made of rigid or flexible plastic material. Fitting of the fixing tab 50 can be performed by any assembly means, currently available or later developed.

FIGS. 5 to 8 show the protection device 52 for the non-apparent side of the door. In FIGS. 5 to 8, another protection device 52 is provided opposite the tubular elements 46, being arranged on the non-apparent side of the hinges 42, 44 between the rear edge 48 of the door 10 and the edge of the frame 14. It comprises a strip 54 of flexible or semi-rigid material of small thickness extending over the whole height of the door 10 and fixed to the frame 14 via one of its ends by a fixing part 56. During pivoting of the door 10, the strip 54 is animated with a relative sliding movement being deformed angularly in the zone to be protected and remaining appreciably parallel with respect to the adjacent face 58 of the door 10. Sliding of the strip 54 is achieved by means of a guiding part 60 securedly affixed to the face 58 of the door 10 so as to arrange a pre-determined clearance. The strip 54 has a high mechanical strength and is made for example from a plastic material with a polystyrene, polyurethane, chlorinated polymer or other base.

The fixing part 66 of the strip 54 is advantageously rounded over the whole height thereof so as to perform preliminary bending of said curved surface at a predetermined angle. In various exemplary embodiments, the predetermined angle is between 40° and 90°. Such an arrangement enables the bending stress of the strip 54 when the door 10 is opened and closed to be reduced, by preventing the strip 54 from moving away from the face 58 of the door 10.

The strip 54 and the plate 64 extend right down to the bottom of the door 10 so as to achieve total protection.

The vertical edge of the plate 64 opposite the hinges 42, 44 is secured to the door 10 by assembly elements 86 arranged along the vertical edge so as to form a continuous guiding slot with a closed bottom for housing the sliding part of the strip 54, which strip is then hidden throughout the sliding travel. It is also possible to integrate the guiding slot directly in the door 10.

According to another type of door, it is clear that the strip 54 can be fixed to the movable door 10 and the guiding part 60, be secured to the fixed frame 14.

What is claimed is:

1. A mechanical safety device for a door pivotally mounted on a frame, the device comprising protection means for preventing access to a vertical gap between the frame and an edge of the door on a side where hinges are located and a strip opposite said protection means cooperating with a guiding part to allow a relative sliding movement of a free end of the strip when the door moves relative to the frame, the guiding part being adapted to be fixed to the door by assembly elements, wherein a fixing part for fixing the strip onto the frame comprises means for rounding the strip over the length thereof so as to perform a preliminary bending of the strip at a predetermined angle, the guiding part comprises a plate made of rigid plastic material for housing the strip, the guiding part also including a closed bottom, and the strip and the plate are adapted to extend to the bottom of the door.

2. The mechanical safety device according to claim 1, wherein the strip is made of plastic material and is adapted to remain appreciably parallel to the door within the guiding part.

3. The mechanical safety device according to claim 1, wherein the protection means comprises a tubular element adapted to be fitted in the gap in vertical alignment with the hinges to form a non-deformable static shield, the tubular element having a diameter close to that of each hinge.

4. The mechanical safety device according to claim 3, wherein the tubular element is provided with a flat fixing tab adapted to be attached to one of the frame and the door.

5. The mechanical safety device according to claim 4, wherein the tubular element and the fixing tab are made of one of a rigid plastic material and flexible plastic material.

6. The mechanical safety device according to claim 1, wherein the predetermined angle is between 40° and 90°.

7. The mechanical safety device according to claim 1, wherein the strip is made of a flexible material.

8. The mechanical safety device according to claim 1, wherein the strip is made of a semi-rigid material.

* * * * *